US010957275B2

(12) United States Patent
Wu

(10) Patent No.: US 10,957,275 B2
(45) Date of Patent: Mar. 23, 2021

(54) PIXEL COMPENSATING METHOD, PIXEL COMPENSATING CIRCUIT AND DISPLAY DEVICE

(71) Applicant: Xianyang Caihong Optoelectronics Technology Co., Ltd, Xianyang (CN)

(72) Inventor: Yuan-Liang Wu, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 74 days.

(21) Appl. No.: 16/188,510

(22) Filed: Nov. 13, 2018

(65) Prior Publication Data

US 2019/0147827 A1 May 16, 2019

(30) Foreign Application Priority Data

Nov. 15, 2017 (CN) ..... 2017109492325

(51) Int. Cl.
*G09G 3/36* (2006.01)

(52) U.S. Cl.
CPC ..... *G09G 3/3696* (2013.01); *G09G 3/3648* (2013.01); *G09G 3/3677* (2013.01); *G09G 3/3688* (2013.01); *G09G 2310/0251* (2013.01); *G09G 2310/08* (2013.01); *G09G 2320/0219* (2013.01); *G09G 2320/0247* (2013.01); *G09G 2320/0257* (2013.01); *G09G 2320/0285* (2013.01)

(58) Field of Classification Search
CPC .. G09G 3/3696; G09G 3/3677; G09G 3/3648; G09G 2320/0219; G09G 2320/0285; G09G 2320/029; G09G 2320/0295; G09G 2320/0247; G09G 2320/0257; G09G 2320/043; G09G 2320/045; G09G 2320/048
See application file for complete search history.

(56) References Cited

U.S. PATENT DOCUMENTS

2010/0225634 A1* 9/2010 Levey ..... G09G 3/3208 345/212
2013/0328576 A1* 12/2013 Jamal ..... G09G 3/006 324/681
2018/0061312 A1* 3/2018 He ..... G09G 3/325
2018/0182303 A1* 6/2018 Jung ..... G09G 3/3233

* cited by examiner

*Primary Examiner* — Dennis P Joseph
(74) *Attorney, Agent, or Firm* — WPAT, PC

(57) ABSTRACT

The application relates to a pixel compensation method, a pixel compensation circuit and a display device. The pixel compensation method includes: recording a working time of a display device and determining gate and source voltages of a TFT in an active area within the working time; finding a voltage compensation value from a look-up table according to the working time and the gate and source voltages; and performing voltage compensation to a scan signal according to the voltage compensation value. The gate and source voltages in a time period of the display device are counted, the pre-stored look-up table is searched according to voltage statistical values of gate, source and drain to determine voltage adjustment values for adjusting voltage values of the scan signal, so that a problem of image ghost or flicker in the display device caused by the drift of I-V characteristic curve is overcome consequently.

4 Claims, 3 Drawing Sheets

PIXEL COMPENSATING METHOD, PIXEL COMPENSATING CIRCUIT AND DISPLAY DEVICE

FIELD OF THE DISCLOSURE

The disclosure relates to the field of liquid crystal display technologies, and more particularly to a pixel compensating method, a pixel compensating circuit and a display device.

BACKGROUND

A thin film transistor liquid crystal display (TFT-LCD) device is one kind of active matrix liquid crystal displays (AM-LCD), and is the sole display device that fully exceeds cathode ray tube (CRT) display devices in terms of brightness, contrast, power consumption, life, volume and weight. It has properties of excellent performance, large-scale production characteristics, high automation for manufacturing, low cost of raw materials and broad development space.

Referring to FIG. 1 and FIG. 2, FIG. 1 is a schematic structural view of a TFT in an active area in related art, and FIG. 2 is a schematic view showing I-V characteristic curves of a certain TFT in the active area in related art. For properties of an amorphous silicon TFT itself, as long as a gate and a source/drain have a voltage difference for a long time, the I-V characteristic of the TFT would be changed, that is, a drain current $I_D$ would drift under a same gate-source voltage $V_{GS}$. For pixels of a liquid crystal panel, the amorphous silicon TFT is used in such a manner that a gate voltage is kept at a low level and source and drain voltages are kept at high level for a long time in practical applications. It will cause charging ability of the pixels to be changed, and thereby affecting display effect of the liquid crystal panel, for example, phenomena of image ghost and flicker may appear.

SUMMARY

On such basis, the disclosure provides a pixel compensating method, a pixel compensating circuit and a display device, so as to solve the above problems existing in related art.

In the disclosure, a pixel compensating method according to an embodiment is provided. The pixel compensating method exemplarily includes steps of: recording a working time of a display device and determining a gate voltage and a source voltage of a TFT in an active area of the display device within the working time; finding a voltage compensation value from a look-up table according to the working time, the gate voltage and the source voltage; and performing voltage compensation to a scan signal of the display device according to the voltage compensation value.

In an embodiment, the step of recording a working time of a display device includes: starting a timing when the display device power on and ending the timing when the display device is powered off to realize the recording of the working time.

In an embodiment, the step of obtaining a gate voltage and a source voltage of a TFT in an active area of the display device includes: obtaining a data signal and a scan signal applied onto a certain TFT of the active area in real time within the working time; and determining the source voltage of the TFT according to an amplitude of the data signal, and determining the gate voltage of the TFT according to an amplitude of the scan signal.

In an embodiment, the look-up table includes a mapping relationship between the voltage compensation value and the working time, the gate voltage, the source voltage and a drain voltage; and the mapping relationship is expressed as that $dV=f(T, V_G, V_S, V_D)$; where dV refers to the voltage compensation value, T refers to the working time, $V_G$ refers to the gate voltage, $V_S$ refers to the source voltage, and $V_D$ refers to the drain voltage.

In an embodiment, the step of finding a voltage compensation value from a look-up table according to the working time, the gate voltage and the source voltage includes: calculating a drain voltage of the TFT according to the source voltage; determining a time-varying voltage compensation curve from the look-up table according to the gate voltage, the source voltage and the drain voltage; and acquiring the voltage compensation value on the time-varying voltage compensation curve according to the working time.

In an embodiment, the step of performing voltage compensation to a scan signal of the display device according to the voltage compensation value includes: when the display device next power on or a display image is switched, adjusting a reference voltage(s) of a scan driving circuit of the display device according to the voltage compensation value to achieve compensation to a gate-on voltage and a gate-off voltage of the scan signal.

In the disclosure, a display device according to an embodiment is provided. The display device includes: a detecting module, configured for recording a working time of the display and obtaining a gate voltage and a source voltage of a TFT in an active area of the display device within the working time; a searching module, configured for finding a voltage compensation value from a look-up table according to the working time, the gate voltage and the source voltage; and a compensating module, configure for performing voltage compensation to a scan signal of the display device according to the voltage compensation value.

In an embodiment, the detecting module is configured for: starting a timing when the display device power on and ending the timing when the display device power off to execute the recording of the working time; obtaining a data signal and a scan signal applied onto a certain TFT in the active area in real time within the working time; and determining the source voltage of the TFT according to an amplitude of the data signal, and determining the gate voltage of the TFT according to an amplitude of the scan signal.

In an embodiment, the compensating module is configured for: when the display device next power on or a display image is switched, adjusting a reference voltage(s) of a scan driving circuit of the display device according to the voltage compensation value, to achieve compensation to a gate-on voltage and a gate-off voltage of the scan signal.

In the disclosure, a pixel compensating circuit according to an embodiment is provided. The pixel compensating circuit is disposed in a display device and includes a processor and a memory. The processor is electrically connected to a timing control circuit, a scan driving circuit and a data driving circuit of the display device; and the processor is configured to obtain a working time of the display device from a timer of the timing control circuit, obtain a gate voltage and a source voltage of a TFT in an active area from a data driving voltage conversion table and a scan driving voltage conversion table respectively, and save the working time, the gate voltage and the source voltage into the memory. The memory is electrically connected to the processor; the memory is configured to store the working time, the gate voltage and the source voltage, and further store a look-up table to allow the processor to find a voltage compensation value from the look-up table according to the working time, the gate voltage and the source voltage.

In an embodiment, the processor is further configured for generating a reference voltage(s) of the scan driving circuit according to the voltage compensation value; correspondingly, the pixel compensating circuit further includes a DAC, and the DAC is configured for converting the reference voltage(s) into an analog voltage(s) outputted to the scan driving circuit.

In the embodiments of the disclosure, the gate voltage and the source voltage within a time period of the display device are counted, a pre-stored mapping table is searched according to the working time of the time period and statistical voltage values of gate, source and drain to determine voltage adjustment values, and the voltage values of the scan signal are adjusted according to the voltage adjustment values, as such, a gate-off voltage of the TFT in the active area can keep a lowest current, which can overcome the problems of image ghost and flicker caused by leakage of pixel capacitor resulting from the drift of I-V characteristic curve.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the drawings.

DETAILED DESCRIPTION OF PREFERRED EMBODIMENTS

Figure 1:
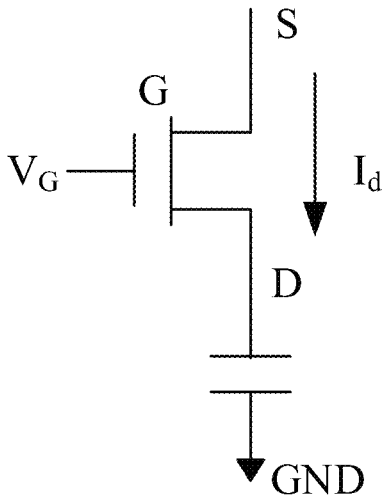
FIG. 1(Related art)
FIG. 1 is a schematic structural view of a TFT in an active area in related art.
Figure 2:
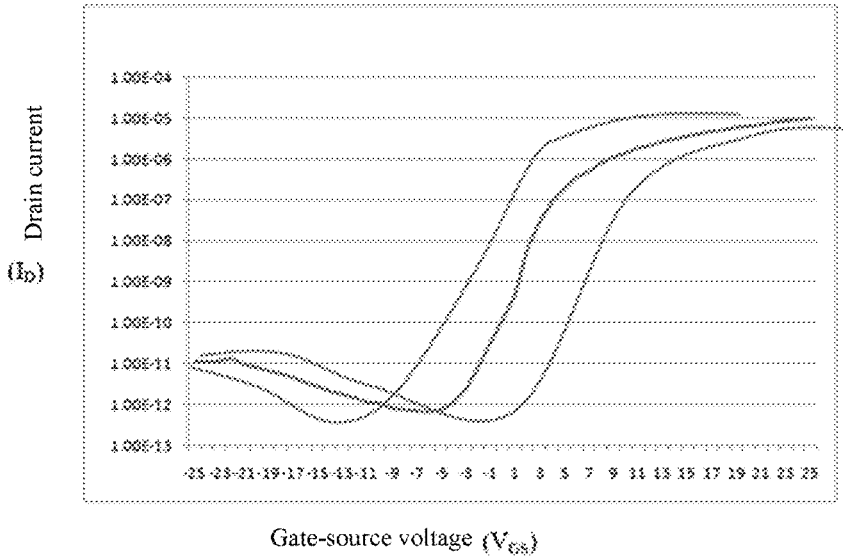
FIG. 2(Related art)
FIG. 2 is a schematic view showing I-V characteristic curves of a certain selected TFT in the active area in related art.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Embodiment 1

Figure 3:
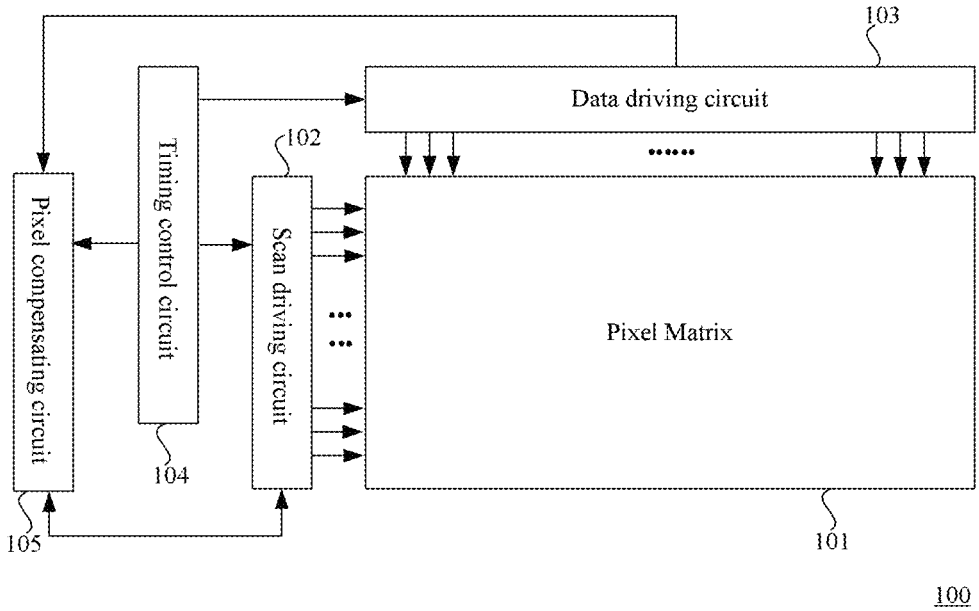
FIG. 3 is a schematic view of a circuit structure of a display device according to an embodiment of the disclosure.
Figure 4:
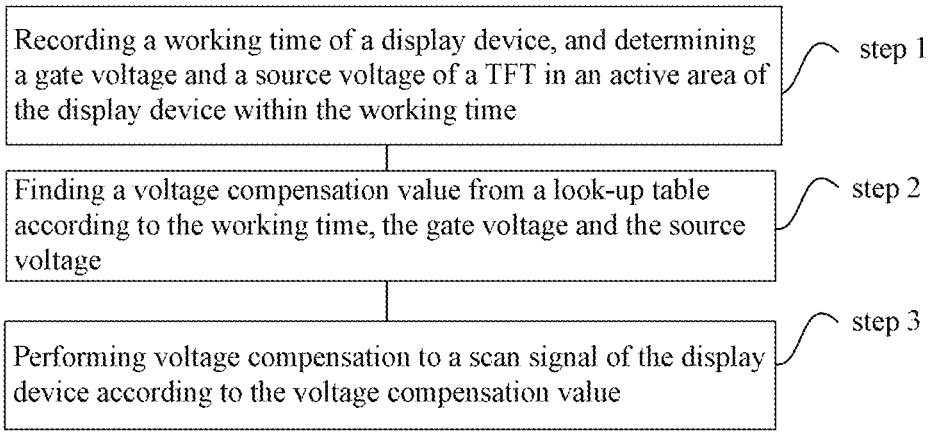
FIG. 4 is a schematic flowchart of a pixel compensating method according to an embodiment of the disclosure.

Please referring to FIG. 3 and FIG. 4, FIG. 3 is a schematic diagram of a circuit structure of a display device 100 according to the embodiment of the disclosure, and FIG. 4 is a schematic flowchart of a pixel compensating method according to the embodiment of the disclosure. The pixel compensating method is suitable for TFT-LCD display devices, and its working principle is also suitable for other display devices such as LED display devices, OLED display device. The method can effectively solve the problem of pixel insufficient charging caused by a drift of I-V characteristic of a TFT suffered from a long-term bias voltage during working.

In particular, the display device 100 may include a pixel matrix 101, a scan driving circuit 102, a data driving circuit 103, a timing control circuit 104 and a pixel compensating circuit 105. The pixel compensating circuit 105 is electrically connected to the scan driving circuit 102, the data driving circuit 103 and the timing control circuit 104 individually. The pixel compensating circuit 105 is configured (i.e., structured and arranged) for acquiring a working time from a timer of the timing control circuit 104, acquiring a source voltage applied to a TFT of the pixel matrix 101 from a pre-designed data driving voltage conversion table, acquiring a gate voltage applied to the TFT of the pixel matrix 101 from a pre-designed scan driving voltage conversion table, generating a voltage compensation value for the pixel matrix 101 according to the working time, the source voltage and the gate voltage, and transmitting the voltage compensation value to the scan driving circuit 102 to adjust scan voltages outputted to the pixel matrix 101, so as to ensure the stable output of drain currents $I_D$.

More specifically, the pixel compensating method is embodied/implemented by the pixel compensating circuit 105 described above. The pixel compensating method exemplarily include following Step 1, Step 2 and Step 3.

Step 1, recording a working time of a display device, and determining a gate voltage and a source voltage of a TFT in an active area within the working time.

Step 2, finding a voltage compensation value from a look-up table according to the working time, the gate voltage and the source voltage.

Step 3, performing voltage compensation to a scan signal of the display device according to the voltage compensation value.

In other words, the pixel compensating circuit 105 includes: a detecting module configured for recording a working time of a display device, and determining a gate voltage and a source voltage of a TFT in an active area of the display device within the working time; a searching module configured for finding a voltage compensation value from a look-up table according to the working time, the gate voltage and the source voltage; and a compensating module configure for compensating a voltage of scan signals of the display device according to the voltage compensation value. In an exemplary embodiment, the detecting module, the searching module and the compensating module are software modules executable by one or more processors.

Regarding the recording of the working time of the display device, it may start a timing when the display device power on and end the timing when the display device power off; or the recording of the working time may be performed in a fixed time period instead.

In this embodiment, the gate voltage and the source voltage of the display device in a time period are counted, a pre-stored mapping table is searched according to the working time of the time period and the statistical/counted voltage values of gate, source and drain to determine a voltage adjustment value(s), and the voltage value(s) of the scan signal is/are adjusted according to the voltage adjustment value(s). As a result, the drain current drift of a TFT suffered from a long-term bias voltage is suppressed and further the problems of image ghost and flicker in the display device are solved.

Embodiment 2

Figure 5:
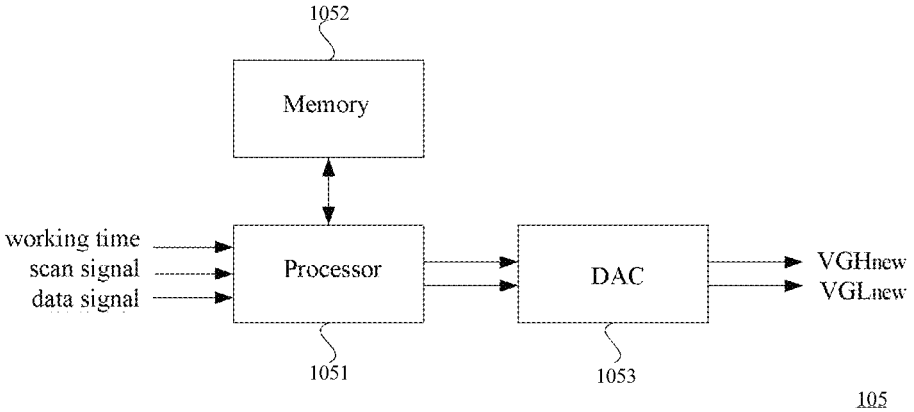
FIG. 5 is a schematic structural view of a pixel compensating circuit according to an embodiment of the disclosure.
Figure 6:
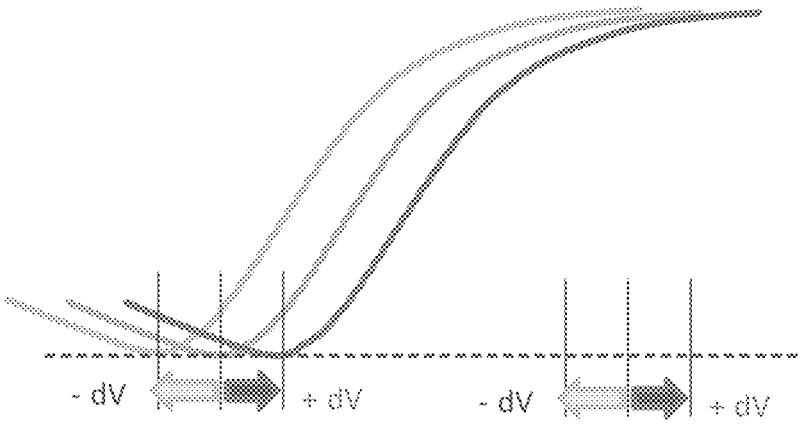
FIG. 6 is a schematic view showing I-V characteristic curves of a TFT according to an embodiment of the disclosure.

Referring to FIG. 5 and FIG. 6, FIG. 5 is a schematic structural view of a pixel compensating circuit according to the embodiment of the disclosure, and FIG. 6 is a schematic view showing I-V characteristic curves of a TFT according to the embodiment of the disclosure. Based on the above embodiment, this illustrated embodiment focuses on a working principle of the pixel compensating circuit and a corresponding pixel compensating method which are described in detail as follows.

The pixel compensating circuit 105 includes a processor 1051, a memory 1052 and a digital-to-analog converter (DAC) 1053. The processor 1051 is electrically connected to the memory 1052 and the DAC 1053 individually.

Specifically, the memory 1052 stores a look-up table (LUT) containing voltage compensation values. The LUT is a set of data obtained by testing the I-V characteristics of a TFT under different conditions. Through the LUT, a time-varying voltage compensation value (dV, that is, LUT value) for the TFT can be found. That is, a driving voltage(s) for the scan driving circuit is/are adjusted by the found LUT value. The LUT value is related to a TFT bias voltage direction, a driving voltage difference and structural characteristics of the TFT itself, so it is necessary to store LUT values in accordance with structural characteristics of the TFT in the active area for different display devices. It should be understood that, a device parameter(s) of a TFT for establishing the LUT may be not exactly the same as the device parameter(s) of the TFT of the active area, in the case of just a small influence on driving voltage and driving current. Of course, it is relatively better that device parameter(s) of the TFT for establishing the LUT are fully the same as that of the TFT in the active area.

In addition, referring to FIG. 6, positive and negative of LUT values indicate compensating directions of a turn-on voltage (VGH) and a turn-off voltage (VGL) of the scan signal. For example, if dV is negative, the entire I-V curve will move to the left, that is, in order to achieve a same TFT drain current $I_D$, the gate voltage is needed to be reduced. If dV is positive, the entire I-V curve will move to the right, that is, in order to achieve a same TFT drain current $I_D$, the gate voltage is needed to be increased.

Specifically, when powers on, the processor 1051 acquires a boot starting time from a timer of the timing control circuit 104, starts to acquire a data signal and a scan signal applied to the active area in real time and determines a gate voltage and a source voltage applied to a TFT in the active area, namely $V_G$ and $V_S$, according to voltage amplitudes of the data signal and the scan signal. Then, the processor 1051 retrieves the LUT from the memory 1052, performs a calculation based on these parameter values and then finds a corresponding LUT value from the LUT, and finally adjusts the turn-on voltage and the turn-off voltage (e.g., VGH and VGL) of the scan signal according to the LUT value and then sends adjusted $VGH_{new}$ and $VGL_{new}$ to the DAC 1053 to produce analog signals. The analog signals then are transmitted to a power management integrated circuit (PMIC). The PMIC adjusts reference voltages of the scan driving circuit based on the analog signals, so as to achieve adjustment of scan signal for the TFT in the active area.

It is noted that, a manner of compensating a driving voltage for the TFT in the active area according to the LUT value may be one of following first through third manners.

The first manner is that: adding the LUT value on the gate-on voltage for the TFT in the active area, or subtracting the LUT value from the gate-on voltage for the TFT in the active area;

The second manner is that: adding the LUT value on the gate-off voltage for the TFT in the active area, or subtracting the LUT value from the gate-off voltage for the TFT in the active area;

The third manner is that: simultaneously adding the LUT value on or subtracting the LUT value from the gate-on voltage and the gate-off voltage for the TFT in the active area.

The third manner can well ensure positive and negative voltages of the TFT in the active area to have a same value, so as to keep symmetry of the positive and negative voltages.

It should be emphasized that, the adjustment of the voltage amplitude of scan signal can be performed in a time period from power on to power off. That is, during the time period from power on to power off, a gate voltage and a source voltage are counted in the whole process, the voltage compensation value is determined according to the LUT, and then a voltage amplitude adjustment for the scan signal is started immediately when next power on and further the adjustment is completed before the active area starts displaying. Alternatively, the adjustment of the voltage amplitude of scan signal may be performed in real time during a boot process; for example, the adjustment is performed when the display device power on, a display image is switched or a signal source is switched, but it is not limited herein.

In addition, during collecting the data signal(s) and the scan signal(s) applied to the active area in real time, it may collect the data signal and the scan signal of a certain TFT in the active area, or collect the data signals and the scan signals of all TFTs in a certain region of the active area, or other manner, as long as gate voltages and source voltages of particular one or plural TFTs can be obtained, and thus it is not limited herein. Moreover, for the gate voltage and the source voltage collected in real time, an average value of the gate voltages and an average value of the source voltages in the time period may be used as the gate voltage and source voltage determined by counting in the time period. Alternatively, after the previous frame of image is displayed, a TFT corresponding to a pixel with a smallest or largest voltage difference ($V_{GS}/V_{GD}$) is determined as a TFT to be monitored in the next first frame of image, and when displaying the next second frame of image, then select a TFT to be monitored again according to this method and so on, and after the time period is ended, detected sets of $V_G$ and $V_S$ are averaged as the gate voltage and the source voltage determined statistically within the time period. Of course, it can be understood that the corresponding monitoring method needs to be consistent with the previous monitoring method of establishing the LUT, and such adjustment effect will be the best.

In this embodiment, the LUT is pre-stored, and the voltage compensation value is found according to the source voltage and the gate voltage collected in real time as well as the determined working time, thereby realizing flexible adjustment of the driving voltage(s), and adjusting the gate-on voltage and gate-off voltage in real time or in stages (periodically). As a result, the problems of image ghost and flicker in the display device caused by the drift of I-V characteristic curve are overcome.

Embodiment 3

Figure 7:
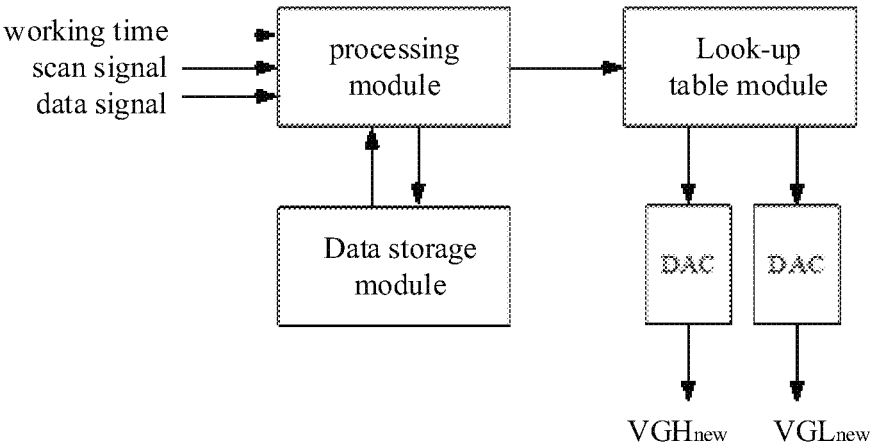
FIG. 7 is a schematic view showing logic modules of a pixel compensating circuit according to an embodiment of the disclosure.
Figure 8:
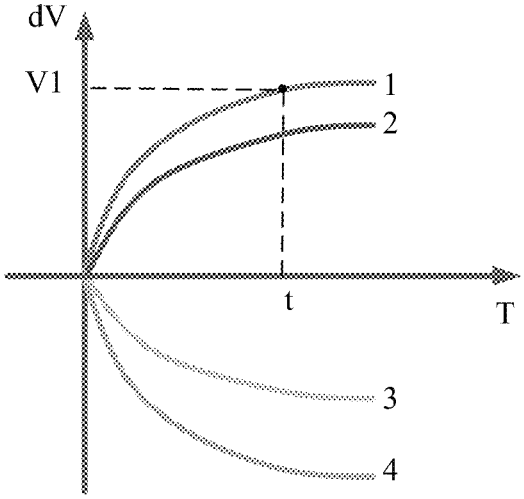
FIG. 8 is a schematic view of curves of LUT according to an embodiment of the disclosure.

Referring to FIG. 7 and FIG. 8, FIG. 7 is a schematic view showing logic modules of a pixel compensating circuit according to the embodiment of the disclosure, and FIG. 8 is a schematic diagram of LUT curves according to the embodiment of the disclosure. On the basis of the above embodiments, this embodiment takes example of collecting one TFT in the active area and increasing or decreasing the turn-on voltage and the turn-off voltage with the same LUT value as an example, and a principle of the pixel compensating method of the disclosure will be described in detail as follows.

After power on, a processing module starts to work, begins to obtain the boot time point from the timer of the timing control circuit, and starts to obtain the gate voltage $V_G$ and the source voltage $V_S$ applied to the TFT from the scan driving circuit and the data driving circuit respectively. At the same time, the drain voltage $V_D$ is calculated according to the source voltage $V_S$ or obtained by testing. The obtained voltages ($V_G$, $V_S$, $V_D$) at each moment are stored in a data storage module, and when power off, the processing module records the working time t and stores it into the data storage module. When next power on, a series of voltages ($V_G$, $V_S$, $V_D$) stored in the data storage module are performed an averaging operation immediately to obtain average values ($V_{G'}$, $V_{S'}$, $V_{D'}$), and then the average values ($V_{G'}$, $V_{S'}$, $V_{D'}$) are used to find a voltage compensation curve matching with the average values ($V_{G'}$, $V_{S'}$, $V_{D'}$) from plural curves 1, 2, 3, 4 stored in a look-up table module, for example the curve 1, as shown in FIG. 8. Theses curves are formed by a plurality of sets of data obtained by testing I-V characteristics of the TFT under different conditions. After that, according to the working time t, a corresponding dV=V1 is determined from the curve 1, and V1 is a positive value. V1 is added onto the voltage amplitude of the current scan signal by the look-up table module, i.e., $VGH_{new}$=VGH+V1, $VGL_{new}$=VGL+V1, and these $VGH_{new}$ and $VGL_{new}$ are converted into analog signals by DAC modules and then provided to the scan driving circuit.

The beneficial effects of this embodiment are the same as those of the foregoing embodiments, and thus will not be repeated herein.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A pixel compensating method comprising:

recording a working time of a display device, and determining a gate voltage and a source voltage of a TFT in an active area of the display device within the working time;

finding a voltage compensation value from a look-up table according to the working time, the gate voltage and the source voltage; and performing voltage compensation to a scan signal of the display device according to the voltage compensation value;

wherein the look-up table includes a mapping relationship between the voltage compensation value and the working time, the gate voltage, the source voltage and a drain voltage; and the mapping relationship is expressed as that:

$$dV=f(T,VG,VS,VD);$$

where dV refers to the voltage compensation value, T refers to the working time, VG refers to the gate voltage, VS refers to the source voltage, and VD refers to the drain voltage;

wherein the step of finding a voltage compensation value from a look-up table according to the working time, the gate voltage and the source voltage further comprising:

storing the gate voltage, the source voltage, and the drain voltage at each moment of the working time to obtain a series of the gate voltages, the source voltages, and the drain voltages;

performing an averaging operation to the series of the gate voltages, the source voltages, and the drain voltages to obtain average values of the series of the gate voltages, the source voltages, and the drain voltages;

determining a time-varying voltage compensation curve from the look-up table according to the average values of the series of the gate voltages, the source voltages, and the drain voltages; and acquiring the voltage compensation value on the time-varying voltage compensation curve according to the working time, wherein the time-varying voltage compensation curve moves leftwardly when the dV is negative, and the gate voltage is needed to be reduced correspondingly; the time-varying voltage compensation curve moves rightwardly when the dV is positive, and the gate voltage is needed to be increased correspondingly.

2. The pixel compensating method according to claim 1, wherein recording a working time of a display device comprises:

starting a timing when the display device is powered on and ending the timing when the display device is powered off to achieve the recording of the working time.

3. The pixel compensating method according to claim 1, wherein determining a gate voltage and a source voltage of a TFT in an active area of the display device within the working time comprises:

obtaining a data signal and a scan signal applied onto a certain TFT of the active area in real time within the working time; and determining the source voltage of the TFT according to an amplitude of the data signal, and determining the gate voltage of the TFT according to an amplitude of the scan signal.

4. The pixel compensating method according to claim 1, wherein performing voltage compensation to a scan signal of the display device according to the voltage compensation value comprises:

when the display device next power on or a display image is switched, adjusting a reference voltage(s) of a scan driving circuit of the display device according to the voltage compensation value to achieve compensation to a gate-on voltage and a gate-off voltage of the scan signal.

* * * * *